US010731516B2

(12) United States Patent
Lee et al.

(10) Patent No.: US 10,731,516 B2
(45) Date of Patent: Aug. 4, 2020

(54) SLIDING SPRING CONTACTS PROVIDING ELECTRICAL POWER TO ROCKER ARMS

(71) Applicant: Eaton Intelligent Power Limited, Dublin (IE)

(72) Inventors: Andrew Lee, Portage, MI (US); Michael J. Campbell, Scotts, MI (US); Austin Robert Zurface, Dowling, MI (US); Dale Arden Stretch, Novi, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/508,686

(22) Filed: Jul. 11, 2019

(65) Prior Publication Data

US 2020/0018195 A1 Jan. 16, 2020

Related U.S. Application Data

(60) Provisional application No. 62/697,981, filed on Jul. 13, 2018.

(51) Int. Cl.

| | |
|---|---|
| ***F01L 1/34*** | (2006.01) |
| ***F01L 1/18*** | (2006.01) |
| ***F01L 13/00*** | (2006.01) |
| ***F01L 1/245*** | (2006.01) |

(52) U.S. Cl.
CPC ..... *F01L 1/185* (2013.01); *F01L 1/245* (2013.01); *F01L 13/0005* (2013.01)

(58) Field of Classification Search
CPC ..... F01L 1/185; F01L 1/245; F01L 13/0005
See application file for complete search history.

(56) References Cited

U.S. PATENT DOCUMENTS

| | | | | |
|---|---|---|---|---|
| 3,040,217 | A | 6/1959 | Conrad | |
| 4,203,397 | A * | 5/1980 | Soeters, Jr. | F01L 1/185 123/90.16 |
| 5,544,626 | A | 8/1996 | Diggs et al. | |
| 5,896,076 | A | 4/1999 | van Namen | |
| 6,318,318 | B1 | 11/2001 | Jahr | |
| 2008/0006232 | A1 | 1/2008 | Gregor et al. | |
| 2018/0142583 | A1 | 5/2018 | Liskar et al. | |

FOREIGN PATENT DOCUMENTS

| | | |
|---|---|---|
| DE | 10310220 A1 | 9/2004 |
| EP | 2050933 A1 | 4/2009 |

* cited by examiner

*Primary Examiner* — Zelalem Eshete
(74) *Attorney, Agent, or Firm* — Paul V. Keller

(57) ABSTRACT

A valvetrain for an internal combustion engine includes a camshaft and a rocker arm assembly. The rocker arm assembly includes an electrical device, a rocker arm, and a cam follower. A contact held to the rocker arm abuts a spring attached to a component distinct from the rocker arm assembly to form an interface. The electrical device is powered through the interface. The spring slides over the contact as the rocker arm assembly pivots to actuate a moveable valve. The interface is formed near a pivot axis whereby the motion undergone by the interface is much less than the motion undergone by points on the rocker arm assembly more distal from the axis. Keeping the interface proximate the pivot axis and leaving the spring free to slide over the contact reducing the extent to which the spring undergoes movement and wear during valvetrain operation.

20 Claims, 6 Drawing Sheets

SLIDING SPRING CONTACTS PROVIDING ELECTRICAL POWER TO ROCKER ARMS

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an Engine Control Unit (ECU). A separate feed from the same source provides oil for hydraulic lash adjustment. This means that each rocker arm has two hydraulic feeds, which entails a degree of complexity and equipment cost. The oil demands of these hydraulic feeds may approach the limits of existing supply systems.

Using electromechanical latch assemblies instead of hydraulically-actuated latches can reduce complexity and demands for oil in some valvetrain systems. Electromechanical latch assemblies create the need to provide electrical power to the valvetrain. Valvetrain electrical power is also desirable for devices that could provide on board diagnostic information for cylinder deactivating and switching rocker arm assemblies.

SUMMARY

The present teachings relate to a valvetrain suitable for an internal combustion engine of a type that includes a combustion chamber and a moveable valve having a seat formed within the combustion chamber. The valvetrain includes a camshaft, a lash adjuster, and a rocker arm assembly. The rocker arm assembly includes an electrical device, a rocker arm, and a cam follower configured to engage a cam on the camshaft as the camshaft rotates. A contact held to the rocker arm abuts a spring attached to a component distinct from the rocker arm assembly to form an interface. The electrical device is powered through the interface. The spring slides over the contact as the rocker arm assembly pivots to actuate a moveable valve. The interface may be formed near a pivot axis whereby the motion undergone by the interface is much less than the motion undergone by points on the rocker arm assembly more distal from the axis. Keeping the interface proximate the pivot axis and leaving the spring free to slide over the contact reducing the extent to which the spring undergoes movement and wear during valvetrain operation.

The lash adjuster provides a fulcrum for the rocker arm assembly. In some of these teachings, the spring extends and contracts along a direction in which the lash adjuster extends and contracts to adjust lash. In some of these teachings, one end of the spring is attached to a framework that abuts the lash adjuster. In some of these teachings the spring has a first end that abuts the contact surface, a second end that is distal from the contact surface and is held in a fixed position. In some of these teachings, that fixed position is proximate a cylinder head. In some of these teachings, the contact is held to a side of the rocker arm and presents a contact surface that is close to and parallel to an axis on which the rocker arm assembly pivots to actuate the moveable valve.

In some of these teachings the spring is ribbon-shaped. In some of these teachings, a face of the spring abuts a face of the contact. This configuration may provide a high contact area. In some of these teachings the spring curves to form convex and concave sides and a concave side of the spring abuts the contact. The contact may be a pin although in some of these teachings, the contact is provided by a ribbon of metal.

In some of these teachings the spring is an accordion spring. The spring may have two straight arms connected by a hoop. In some of these teachings, the hoop is larger than required to connect the ends of the straight arms with a steady curve. In some of these teachings, the two straight arms are connected to the hoop by bends having a curvature opposite a curvature of the hoop.

In some of these teachings, the spring is partially enclosed by a spring box in a manner that resists twisting of the spring. The spring may be flat. The spring box may include two parallel sides. A flat face of the spring may bend between the two parallel sides while the flat face remains perpendicular to those sides.

In some of these teachings, the spring wraps around the contact to provide an interference fit. In some of these teachings the spring forms a hoop around a contact that is in the form of a pin. These configurations increase the reliability with which an electrical connection between the spring and the contact is maintained.

In some of these teachings, the contact surface is proximate a pivot axis for the rocker arm assembly. Preferably, the contact is on the pivot axis. In some of these teachings the rocker arm forms a spring post proximate the pivot axis and the contact is installed on the spring post. In some of these teachings the contact is support by a pin piloted to the rocker arm. The rocker arm may be made of a conductive material. In some of these teachings the pin is held within an insulating sleeve in the rocker arm. In some of these teachings a lead for the electrical device is soldered to the contact.

In some of these teachings, the electrical device is an electromechanical latch assembly. The electromechanical latch assembly may include a latch pin and an electrical coil. The electrical coil may be mounted on a rocker arm of the rocker arm assembly. Alternatively, the electrical device may be a sensor that provides information useful for diagnostic or control operations.

In some of these teachings the spring bears down on the contact to bias the rocker arm assembly against the lash adjuster. In some of these teachings the lash adjuster is a hydraulic lash adjuster. In some of these teachings the spring retains the rocker arm assembly on the lash adjuster. In some of these teachings the spring is anchored to the lash adjuster. Retaining the rocker arm assembly on the lash adjuster using the spring may facilitate installation of the valvetrain.

In some of these teachings a second contact projects from the rocker arm opposite the first contact. First and second leads for the electrical device may be attached to the first and second contacts. Having springs on both sides of the rocker arm balances the forces the springs place on the rocker arm assembly.

Some aspects of the present teachings relate to a method of installing a valvetrain that includes attaching the rocker arm assembly to a pivot, such as a lash adjuster, using the spring and installing the pivot with the attached rocker arm assembly in the cylinder head of an engine. This method simplifies installation of the valvetrain. Moreover, this method allows the valvetrain manufacturer to complete most of the wiring for any electrical devices that are provided with the valvetrain.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
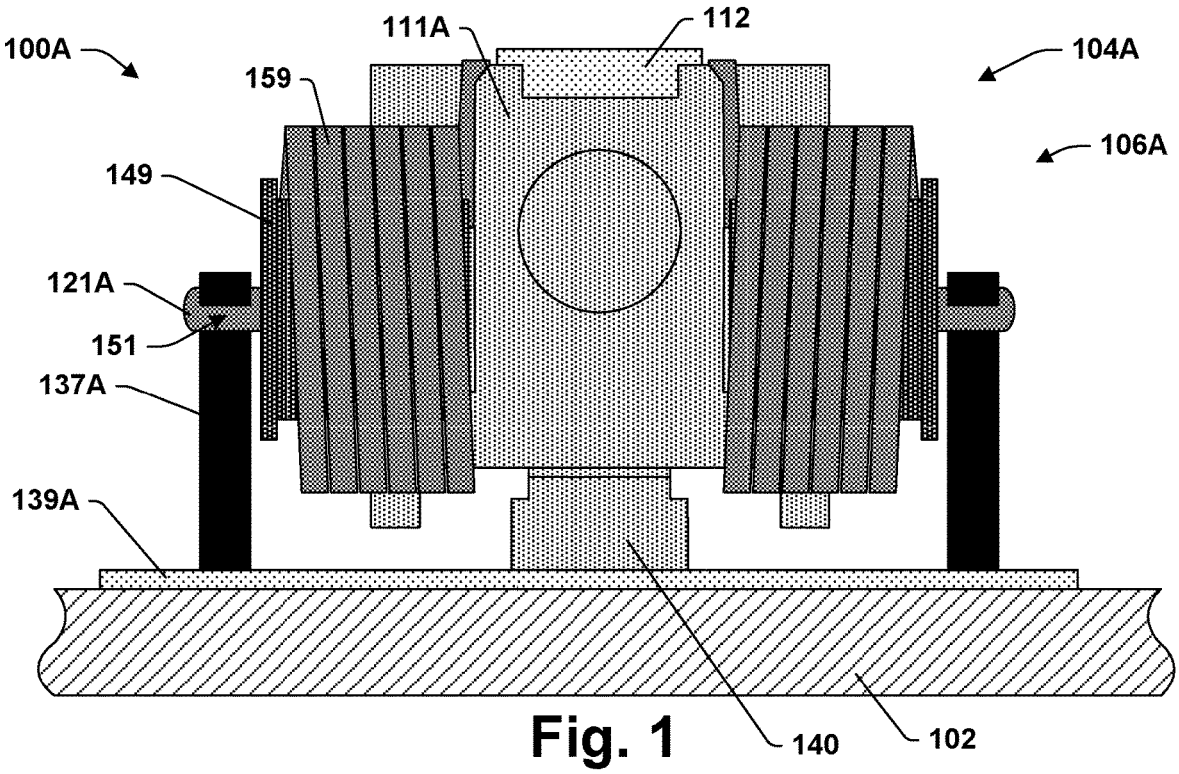
FIG. 1 is a rear view of a rocker arm assembly in a valvetrain of an engine according to some aspects of the present teachings.
Figure 2:
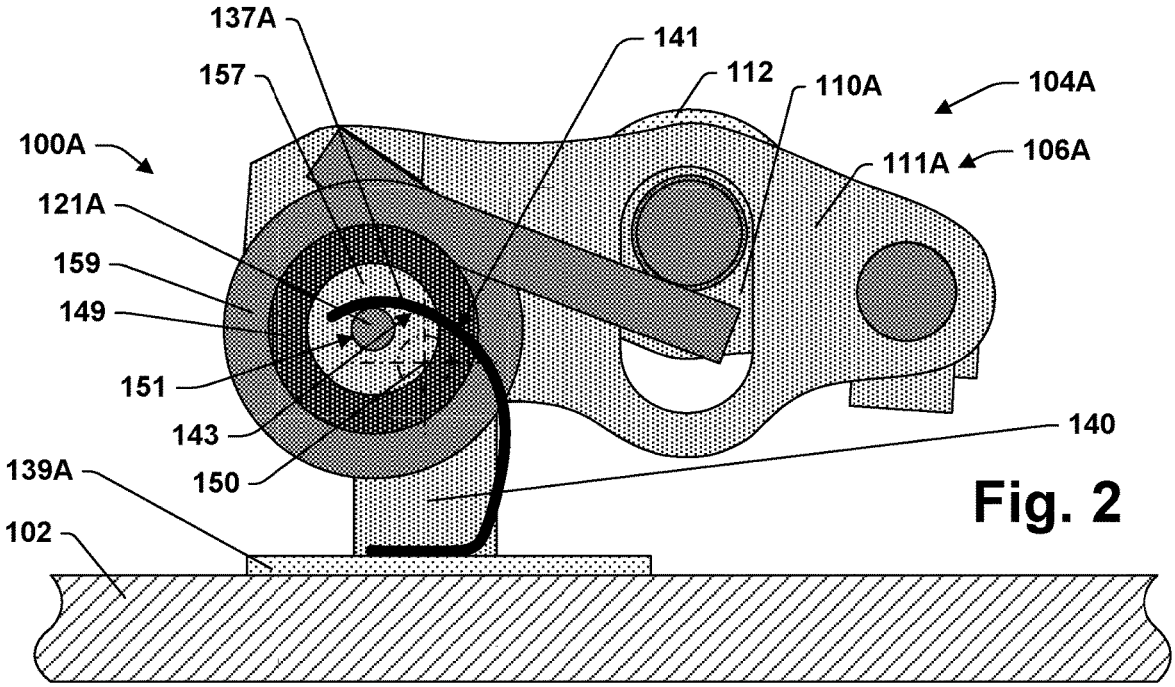
FIG. 2 is a side view of the rocker arm assembly of FIG. 1 in the valvetrain of the engine of FIG. 1.

FIGS. 1 and 2 illustrates a portion of an engine 100A including portions of a cylinder head 102 and a valvetrain 104A. Valvetrain 104A includes hydraulic lash adjuster 140 and rocker arm assembly 106A. Hydraulic lash adjuster 140 is a pivot and is installed in cylinder head 102. Rocker arm assembly 106A is a cylinder deactivating rocker arm that includes an inner arm 110A, an outer arm 111A, and a cam follower 112 mounted to inner arm 110A. Spring posts 157 are formed in outer arm 111A. Torsion springs 159 are mounted on hubs 149 that fit over spring posts 157. Contacts 121A having the form of pins are mounted to outer arm 111A and are piloted in spring posts 157. Hydraulic lash adjuster 140 provides a fulcrum on which rocker arm assembly 106A pivots with a pivot axis that is close to and may intersect contacts 121A.

Figure 3:
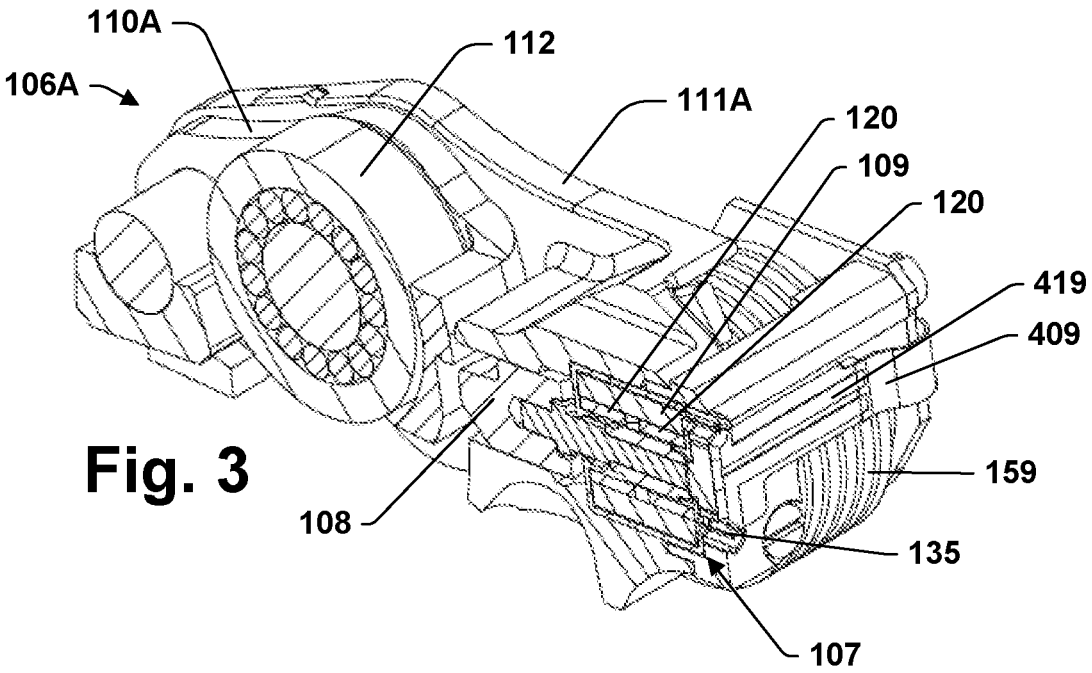
FIG. 3 is a perspective cutaway view of the rocker arm assembly of FIG. 1 fitted with a lead frame.

FIG. 3 illustrates rocker arm assembly 106A in greater detail. Rocker arm assembly 106A includes an electromagnetic latch assembly 107 mounted to outer arm 111A. Electromagnetic latch assembly 107 includes a latch pin 108 and an electrical coil 109. Electrical coil 109 is operable to actuate latch pin 108 between engaging and non-engaging positions. Rotating a camshaft (not shown) actuates rocker arm assembly 106A through cam follower 112. With latch pin 108 in the engaging position, rocker arm assembly 106A is operative to open and close a moveable valve (not shown), such as a poppet valve having a seat formed in cylinder head 102. With latch pin 108 in the non-engaging position, actuating rocker arm assembly 106A by rotating the camshaft causes inner arm 110A to pivot and torsion springs 159 to wind, but leaves outer arm 111A stationary and the moveable valve closed.

In electromagnetic latch assembly 107, magnets 120 make latch pin 108 stable independently from electrical coil 109 in both engaging and non-engaging positions. Energized with a DC current in a first direction, electrical coil 109 is operable to actuate latch pin 109 from the engaging to the non-engaging position. Energized with a DC current in the opposite direction, electrical coil 109 is operable to actuate latch pin 108 from the non-engaging position to the engaging position.

Coil 109 is powered through contacts 121A. A lead frame, which is not shown in FIGS. 1 and 2 but may be similar to the lead frame 409 shown on rocker arm 106A in FIG. 3 may be used for that purpose. Lead frame 409 includes conductors 413 that may be soldered to contacts 121A. Conductors 419 connect with coil 109 at coil tie-offs 135 at the back of outer arm 111A. Lead frame 409 may be supported in an opening formed in the back of outer arm 111A. Alternatively, or in addition, lead frame 409 may be supported at the sides of outer arm 111A by contacts 121A. Lead frame 409 may be over-molded around conductors 419.

Referring to FIGS. 1 and 2, spring 137A is anchored at one end to a support frame 139A. Support frame 139A abuts hydraulic lash adjuster 140. Having support frame 139A abut hydraulic lash adjuster 140 facilitates locating spring 137A correctly relative to contacts 121A. Support frame 139A surrounds and attaches to hydraulic lash adjuster 140. Spring 137A is anchored to hydraulic lash adjuster 140 through support frame 139A. Support frame 139A may rest on cylinder head 102 and may be attached to cylinder head 102. For example, support frame 139A may be bolted to cylinder head 102. Support frame 139A keeps one end of spring 137A fixed in a position proximate cylinder head 102. In addition to providing an anchor for spring 137A, support frame 139A electrically isolates spring 137A from cylinder head 102.

Spring 137A is a ribbon of conductive metal bent to form convex side 141 and concave side 143. Spring 137 abuts contact 121A on concave side 143. Contact between spring 137A and contact 121A is maintained as rocker arm assembly 106A undergoes motions associated with its normal operation. Those motions include raising and lowering due to lash adjustment and pivoting on hydraulic lash adjuster 140. Spring 137A may slide over a surface 151 of contact 121A as these motions occur. The pivoting action may result in rotation of contact 121A with little or no horizontal extension and contraction of spring 137A. Spring 137A remains in contact with contact 121A as contact 121A undergoes horizontal and vertical motion by flexing and or sliding over the surface of contact 121A. The surface 151 of contact 121A that contacts spring 137A preferably conforms to the shape of spring 137A to provide a large area of contact. In this example, conformity is achieved by making both surfaces parallel to pivot axis 150 (see FIG. 2).

Contact 121A is proximate to but slightly off pivot axis 150. Rocker arm assembly 106A may be redesigned or the mounting of contact 121A may be modified to reduce or eliminate this separation. Preferably, contact 121A is 5 mm or less contact from axis 150. More preferably, contact 121A is 2 mm or less from axis 150. More preferably, contact 121A is 1 mm or less from axis 150. Still more preferably, axis 150 passes through contact 121A.

Figure 4:
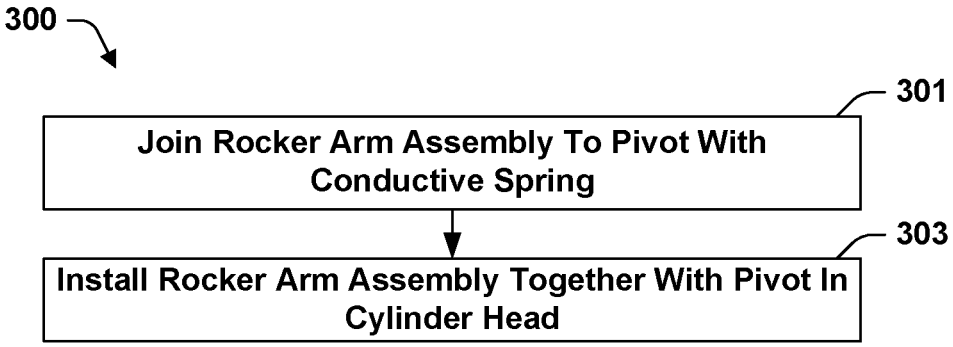
FIG. 4 is a flow chart of a method according to some aspects of the present teachings.

FIG. 4 is a method 300 of manufacturing an engine 100. The method include action 301, joining rocker arm assembly 106A to hydraulic lash adjuster 140 using a spring 137 and installing rocker arm assembly 106A together with hydraulic lash adjuster 140 in cylinder head 102. Support frame 139A may then be anchored to cylinder head 102 with bolts or the like.

Figure 5:
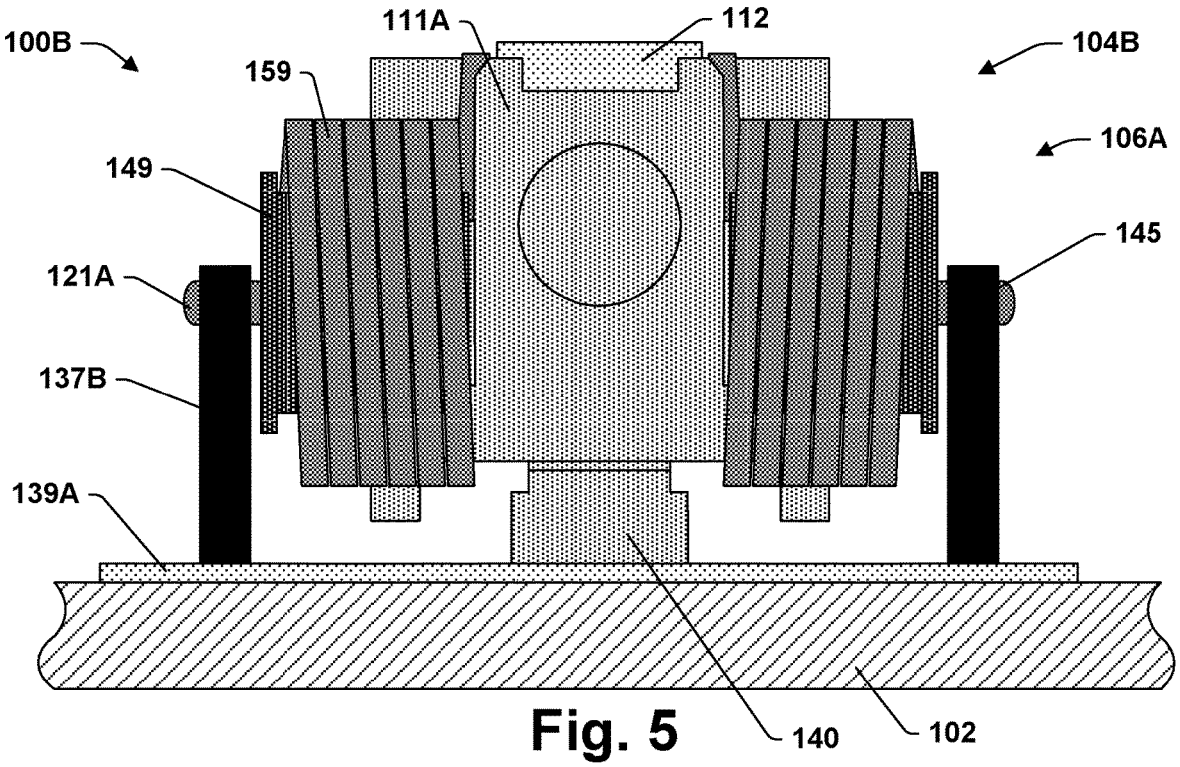
FIG. 5 is a rear view of a rocker arm assembly in a valvetrain of an engine according to some aspects of the present teachings.
Figure 6:
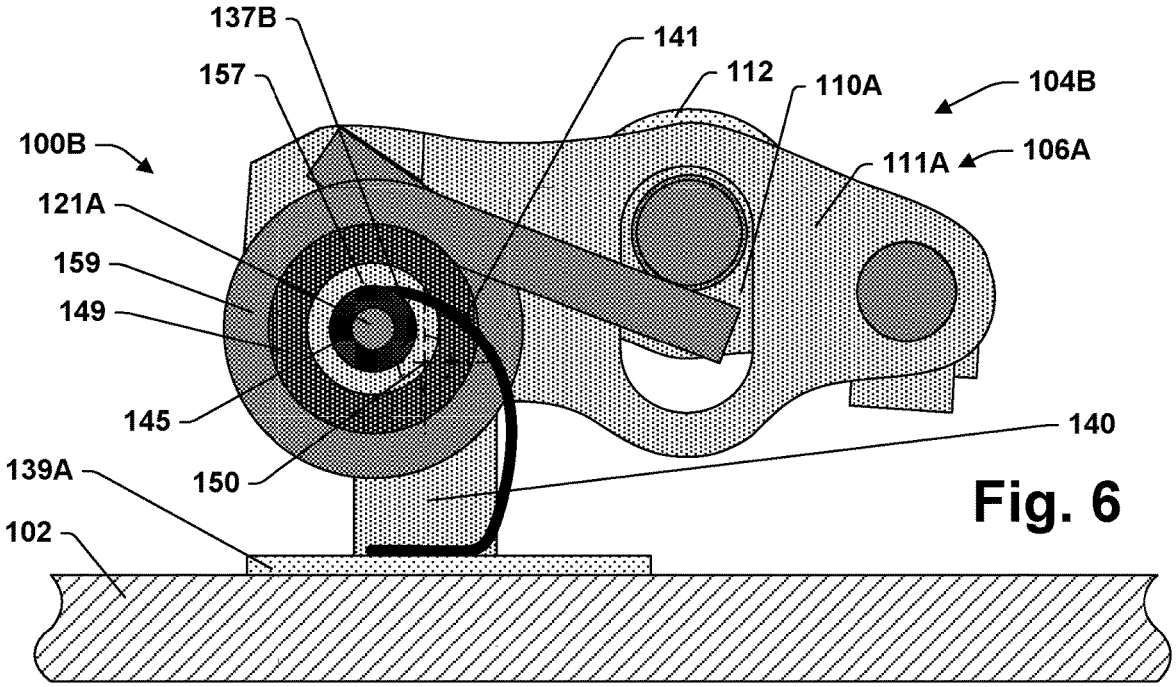
FIG. 6 is a side view of the rocker arm assembly of FIG. 5 in the valvetrain of the engine of FIG. 5.

FIGS. 5 and 6 illustrate an engine 100B that is similar to engine 100A except that it uses a spring 137B in place of spring 137A. Spring 137B forms a hoop 145 that encircles contact 121A. Rather than forming a complete hoop 145, spring 137B could simply wrap around contact 121A to form an interference fit, thereby achieving much the same effect as hoop 145 using only a ribbon of conductive metal.

FIGS. 7-11 illustrates a rocker arm assembly 106C and a hydraulic lash adjuster 140 of a valvetrain 104C according to some aspects of the present teachings. Rocker arm assembly 106C may be a switching rocker am including an inner arm 110C, an outer arm 111C selectively engaged by an electromagnetic latch assembly such as electromagnetic latch assembly 107.

Figure 7:
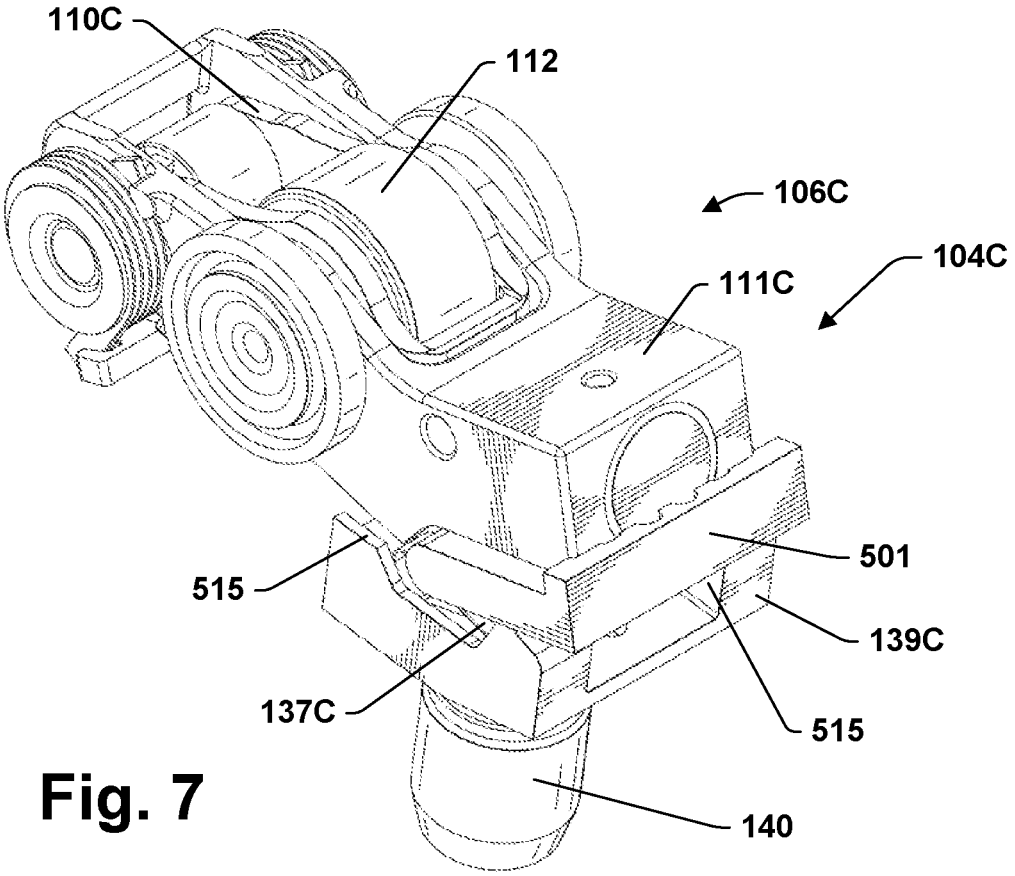
FIG. 7 is a perspective view of rocker arm assembly and a pivot in a valvetrain according to some other aspects of the present teachings.
Figure 8:
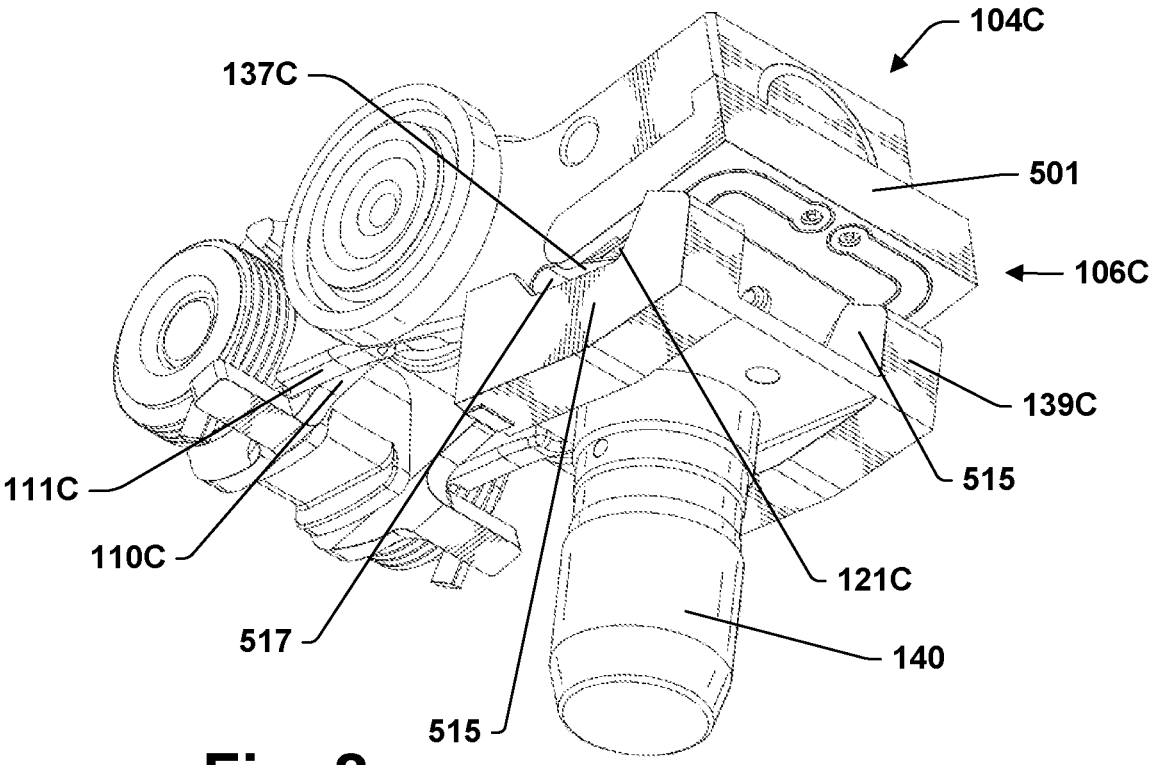
FIG. 8 is another perspective view of the rocker arm assembly and the pivot of FIG. 7.
Figure 9:
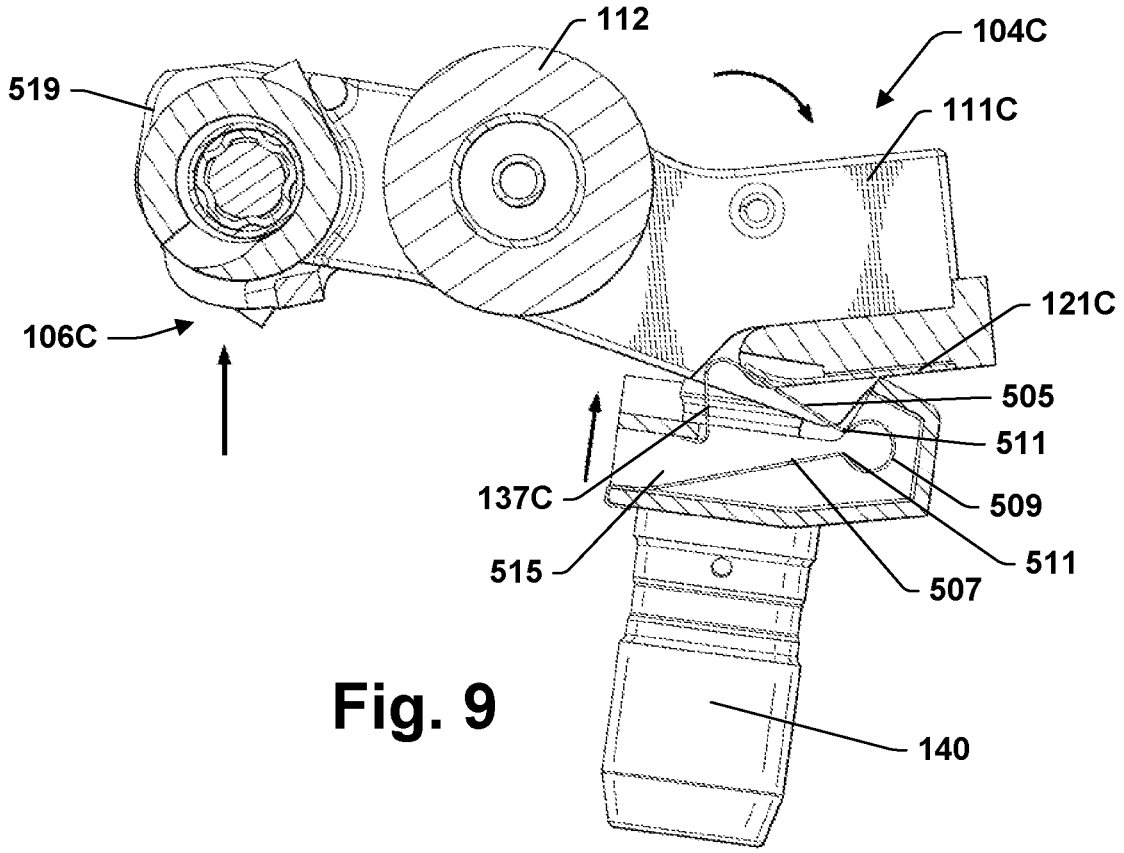
FIG. 9 is a cutaway side view of the rocker arm assembly and the pivot of FIG. 7 with the rocker arm assembly in a valve-closed position and the lash adjuster raised.
Figure 10:
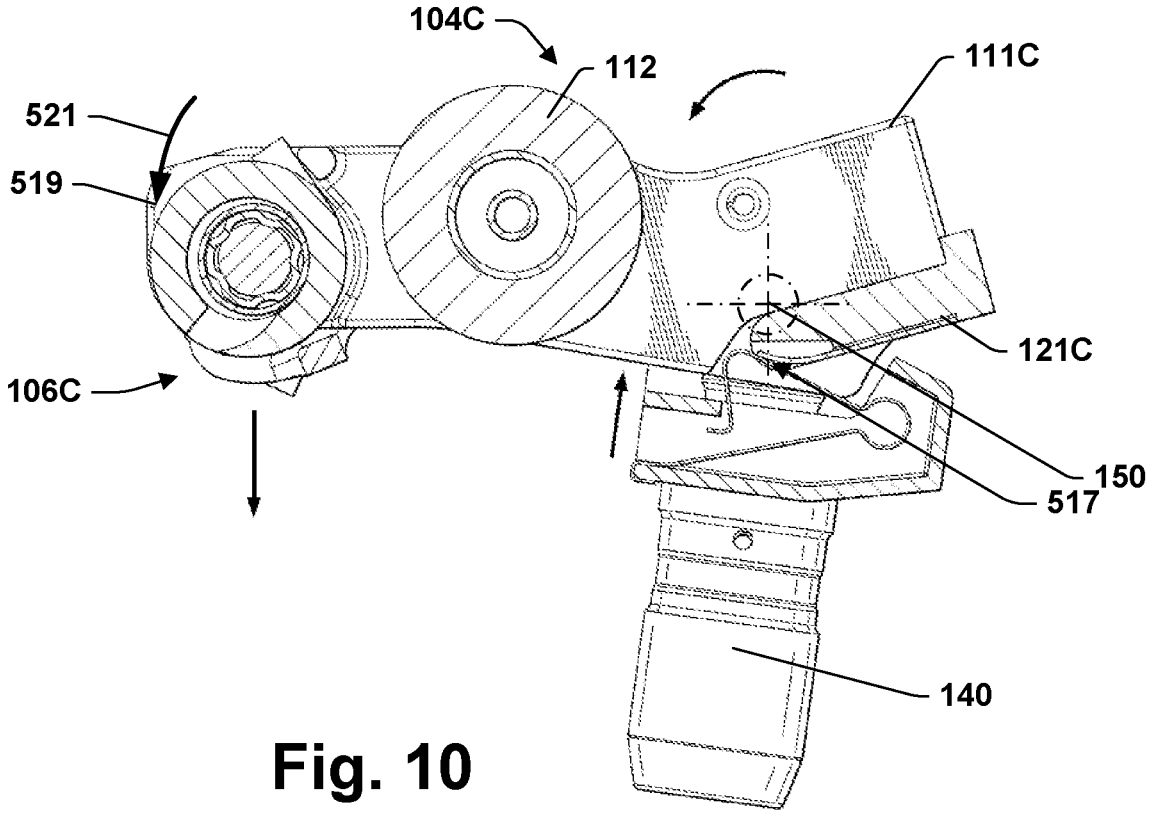
FIG. 10 is the same view as FIG. 9, but with the rocker arm assembly pivoted to a valve-open position.
Figure 11:
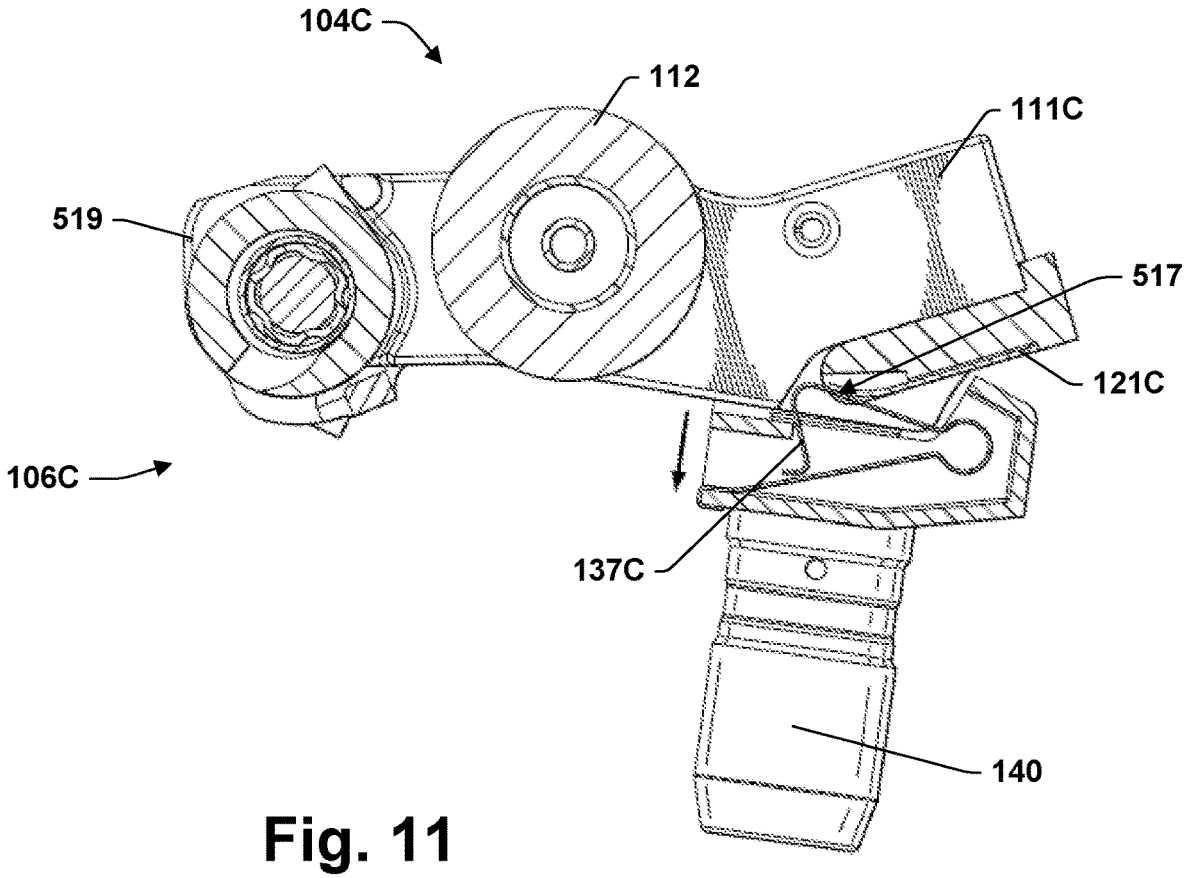
FIG. 11 is the same view as FIG. 9, but with the lash adjuster lowered.

FIGS. 7 and 8 are perspective views that show a contact frame 501 mounted to outer arm 111C and a support frame 139C that fits around hydraulic lash adjuster 140. Support frame 139C may be bolted to a cylinder head 102. FIGS. 9-11 are partial cutaway views showing that contact frame 501 supports and houses two contacts 121C and that support frame 139C supports and houses two springs 137C. Power is provided to a coil 109 through springs 137C and contacts 121C.

With reference to FIG. 9, spring 137C is an accordion spring. An accordion spring is made from a ribbon of metal. Spring 137C extends and contracts along a direction in which hydraulic lash adjuster 140 extends and contracts to adjust lash. Each spring 137C includes a first arm 505 and a second arm 507 connected by a hoop 509. First arm 505 and second arm 507 connect to hoop 509 through bends 511 that have a curvature opposite that of hoop 509. Bends 511 allow hoop 509 to have a radius of curvature greater than a connection between first arm 505 and second arm 507 made with a constant radius of curvature. Hoop 509 may span an arc in the range between 280 and 320 degrees. This configuration keeps the stress on hoop 509 low as first arm 505 and second arm 507 undergo deflection.

Frame 139C includes vertical sidewalls 515, one on either side of each spring 137C. Vertical sidewalls 515 are perpendicular to flat faces 517 (see FIG. 8) of springs 137C and form boxes around springs 137C that protect springs 137C and prevent them from twisting. Contacts 121C are also provided by flat strips of metal. A faces of contact 121C abut a face of spring 137C to provide an electrical connection 517 having a large surface area.

FIGS. 9-11 illustrate how springs 137C maintain electrical connections 517 as rocker arm assembly 106C undergoes various types of motions connected to normal operation of a valvetrain. FIG. 9 shows the position when cams (not shown) that act on with arm assembly 106C are on base circle providing a valve-closed position and lash adjuster 140 is pumped up. FIG. 10 shows the case where rocker arm assembly 106C has pivoted forward to open a valve under the influence of a cam to open a valve. The pivoting action has partially compressed spring 137C. Contact 121C has slid over spring 137C, but contact 517 has been maintained. FIG. 11 shows the case where the cams acting on rocker arm assembly 106C are on base circle, but lash adjuster 140 is pumped down. This causes spring 137C to compress even more than the pivoting of rocker arm assembly 106C but contact 517 is still maintained allowing operation of electromagnetic latch assembly 107.

Contact 517 remains in proximity to axis 150 (See FIG. 10) on which rocker arm assembly 106C pivots. One measure of that proximity is physical distance. That distance may be 5 mm or less, preferably 2 mm or less, more preferably 1 mm or less from axis 150. Another measure of proximity is the ratio between distance moved by contact 517 (too small to clearly illustrate) as rocker arm assembly 106C pivots in comparison to distance 521 (see FIG. 10) moved by a point 519 on rocker arm assembly 106C that is most distal from axis 150. The motion of contact 518 may be 20% or less the motion of point 519, preferably 10% or less, more preferably 5% or less.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber and a moveable valve having a seat formed in the combustion chamber, the valvetrain comprising:

a camshaft;

a rocker arm assembly comprising a rocker arm, an electrical device, and a cam follower configured to engage a cam mounted on the camshaft as the camshaft rotates;

a lash adjuster providing a fulcrum on which the rocker arm pivots to actuate the movable valve;

a contact held to the rocker arm; and a spring attached to a component distinct from the rocker arm assembly and abutting the contact to form an interface;

wherein the spring provides power to the electrical device through the interface;

the spring is configured to slide over the contact as the rocker arm assembly pivots to actuate the moveable valve;

both the interface and a point on the rocker arm assembly distal from the interface undergoes motion as the rocker arm assembly pivots to actuate the moveable valve; and the motion of the interface is 20% or less the motion of the point on the rocker arm assembly distal from the interface.

2. A valvetrain according to claim 1, wherein the spring extends and contracts along a direction in which the lash adjuster extends and contracts to adjust lash.

3. A valvetrain according to claim 1, wherein one end of the spring is attached to a framework that abuts the lash adjuster.

4. A valvetrain according to claim 1, wherein the motion of the interface is 10% or less the motion of the point on the rocker arm assembly distal from the interface.

5. A valvetrain according to claim 1, wherein the spring is an accordion spring.

6. A valvetrain according to claim 5, wherein:

the accordion spring has two straight arms connected by a hoop;

the two straight arms are connected to the hoop by bends having a curvature opposite a curvature of the hoop.

7. A valvetrain according to claim 1, further comprising a spring box that partially encloses the spring in a manner that resists twisting of the spring.

8. A valvetrain according to claim 7, wherein the spring comprises a ribbon of metal having a face perpendicular to a wall of the spring box.

9. A valvetrain according to claim 1, wherein the interface is formed in proximity to an axis on which the rocker arm assembly pivots to actuate the moveable valve.

10. A valvetrain according to claim 9, wherein:

the contact comprises a ribbon of metal having a first face;

the spring comprises a ribbon of metal having a second face; and the interface is formed by abutment between the first face and the second face.

11. A valvetrain according to claim 1, wherein the spring wraps around the contact to provide an interference fit.

12. A valvetrain according to claim 1, wherein the spring forms a hoop around the contact.

13. A valvetrain according to claim 1, wherein:

the spring curves to form a convex side and a concave side; and the spring abuts the contact on the concave side.

14. A valvetrain according to claim 1, wherein:

the contact is held within an insulating sleeve in the rocker arm; and a lead for the electrical device is soldered to the contact.

15. A valvetrain according to claim 1, wherein the electrical device is an electromechanical latch assembly.

16. A valvetrain according to claim 1, wherein the spring bears down on the lash adjuster to bias the rocker arm assembly against the lash adjuster.

17. A valvetrain according to claim 1, wherein the spring retains the rocker arm assembly on the lash adjuster.

18. A valvetrain according to claim 17, wherein the spring is anchored to the lash adjuster.

19. A method of manufacturing an engine with a valvetrain according to claim 18, comprising:

attaching the rocker arm assembly to the lash adjuster using the spring; and installing the lash adjuster with the attached rocker arm assembly in the cylinder head of an engine.

20. A valvetrain for an internal combustion engine of a type that has a combustion chamber and a moveable valve having a seat formed in the combustion chamber, the valvetrain comprising:

a camshaft;

a rocker arm assembly comprising a rocker arm, an electrical device, and a cam follower configured to engage a cam mounted on the camshaft as the camshaft rotates;

a contact held to the rocker arm and presenting a contact surface parallel to and in proximity to an axis on which the rocker arm assembly pivots to actuate a moveable valve; and a spring attached to a component distinct from the rocker arm assembly and abutting the contact surface;

wherein the spring provides power to the electrical device through the contact; and the spring is configured to slide over the contact surface as the rocker arm assembly pivots to actuate the moveable valve.

* * * * *